US005509395A

United States Patent [19]

Cook

[11] Patent Number: 5,509,395

[45] Date of Patent: Apr. 23, 1996

[54] CANISTER PURGE FLOW REGULATOR

[75] Inventor: John E. Cook, Chatham, Canada

[73] Assignee: Siemens Electric Limited, Chatham, Canada

[21] Appl. No.: 414,451

[22] Filed: Mar. 31, 1995

[51] Int. Cl.[6] ..... F02M 33/02

[52] U.S. Cl. ..... 123/518; 123/520

[58] Field of Search ..... 123/516–520, 123/458; 137/599.1, 907, 516.27

[56] References Cited

U.S. PATENT DOCUMENTS

| | | | |
|---|---|---|---|
| 4,480,661 | 11/1984 | Kawai et al. | 137/599.1 |
| 5,069,188 | 12/1991 | Cook | 123/518 |
| 5,083,546 | 1/1992 | Detweiler et al. | 123/520 |
| 5,199,404 | 4/1993 | Cook et al. | 123/520 |
| 5,373,822 | 12/1994 | Thompson | 123/520 |
| 5,448,981 | 9/1995 | Cook et al. | 123/520 |

*Primary Examiner*—Thomas N. Moulis

[57] ABSTRACT

A canister purge flow regulator for regulating the purging of a fuel vapor collection canister to the engine. The purge flow regulator has in the purge flow path, two parallel branch paths, and an associated valve for each branch path. The two valves are operatively related for motion in unison by an actuating mechanism. When the two valves are closed, manifold vacuum is applied in opposite senses, thereby canceling the effect of variations in manifold vacuum on opening of the purge flow regulator. The actuating mechanism senses the differential pressure drop across an orifice in the flow path to automatically adjust the valves to maintain the purge flow commanded by an electric signal input to a solenoid.

24 Claims, 2 Drawing Sheets

CANISTER PURGE FLOW REGULATOR

FIELD OF THE INVENTION

This invention relates generally to evaporative emission control systems of automotive vehicles, and particularly to a canister purge flow regulator for regulating the purging of a fuel vapor collection canister to the engine.

BACKGROUND AND SUMMARY OF THE INVENTION

A typical evaporative emission control system of an automotive vehicle has a vapor collection canister that collects fuel vapors resulting from the volatilization of liquid fuel in the fuel tank so that these vapors do not escape to atmosphere. The collected vapors are periodically purged from the canister to the engine where they entrain with the induction flow for ensuing combustion in combustion chamber space of the engine. Such canister purging occurs under conditions of engine operation that are conducive to purging, consistent with emission laws and regulations applicable to automotive vehicles.

Various forms of canister purge valves have heretofore been proposed and/or used to control the canister purging. Certain forms utilize an electromechanical actuator that controls the opening of a canister purge valve in accordance with an electrical control signal from an engine control computer that manages various functions associated with engine operation. Examples of various canister purge valves are disclosed in commonly assigned patents, such as U.S. Pat. No. 5,199,404, for example.

In certain respects the present invention may be considered as providing further improvements in canister purge valves like those disclosed in U.S. Pat. No. 5,199,404.

One improvement provided by a canister purge flow regulator embodying principles of the present invention is the achievement of better purge control because the effects of detrimental influences on purge control that are attributable to variations in inlet and outlet port differential pressures acting on the purge flow regulator are significantly lessened. Consequently, not only is more accurate purge control attained, but controlled purging can occur at even smaller magnitudes of intake manifold vacuum. Certain prior purge flow regulators were incapable of performing controlled purging at such low intake manifold vacuums.

Another improvement relates to the absence of a bleed path to atmosphere in the inventive canister purge flow regulator; such a bleed was needed in certain prior devices. Generally, elimination of bleed paths in engine system components improves engine idling characteristics, and desirably enables lower engine idle speeds. Thus, absence of a bleed path in the inventive device improves engine operation at low idle speeds, and also eliminates what otherwise might be a potential entrance path for intrusion of minute contaminants in certain operating environments.

Still another improvement relates to the ability of the inventive canister purge flow regulator to respond accurately to an electrical input signal commanding a certain purge flow and to automatically compensate for pressure changes occurring during purge flow that could otherwise significantly alter the commanded purge flow.

The canister of the present invention also incorporates direct electrical actuation, which enables quicker response to any change in input control electrical signals than previously known vacuum operated devices.

Still another improvement provides the potential for reducing certain package size dimensions; such reductions can be significant in facilitating packaging installation in any vehicle where space is at a premium.

The foregoing, as well as further features, advantages, and benefits of the invention, will be seen in the ensuing description and claims which are accompanied by drawings. The drawings disclose a presently preferred embodiment of the invention according to the best mode contemplated at this time in carrying out the invention.

DESCRIPTION OF THE PREFERRED EMBODIMENT

Figure 1:
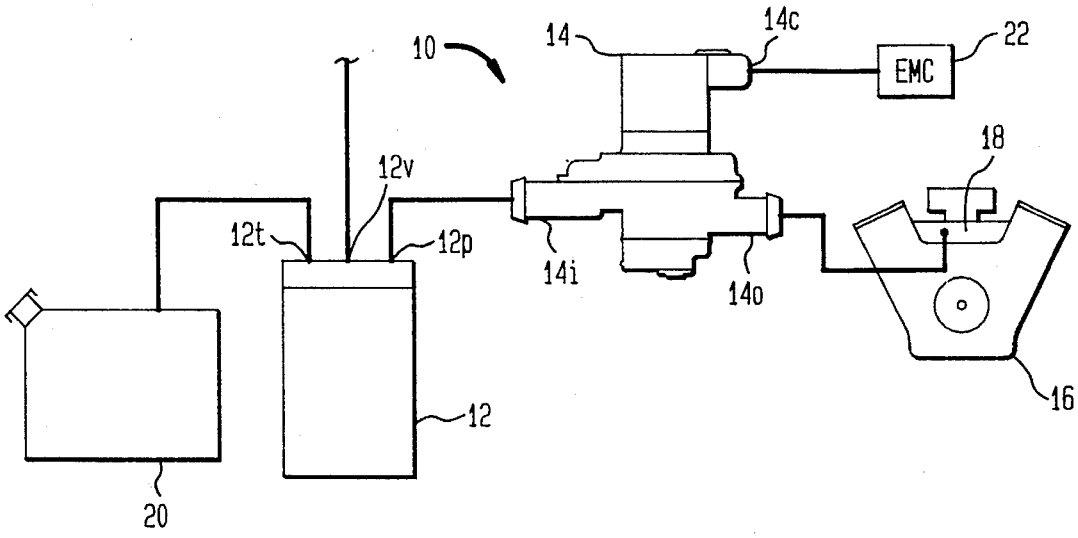
FIG. 1 is a general block diagram of an evaporative emission control system in an automotive vehicle.

FIG. 1 shows an evaporative emission control system 10 comprising a vapor collection canister 12 and a canister purge flow regulator 14 embodying principles of the present invention. System 10 is installed in an automotive vehicle that is powered by an internal combustion engine 16 having an intake manifold 18. Liquid fuel for engine 16 is stored in a fuel tank 20 and supplied to the engine by conventional means which are not shown here.

Canister 12 has a tank port **12*t*, a purge port 12*p*, and a vent port 12*v*. Canister purge flow regulator 14 has an inlet port 14*i* and an outlet port 14*o*. Tank port 12*t* is placed in flow communication with the head space of fuel tank 20, vent port 12*v* is vented to atmosphere, and purge port 12*p* is placed in flow communication with inlet port 14*i* of canister purge flow regulator 14. Outlet port 14*o* is placed in flow communication with engine intake manifold 18**.

Canister purge flow regulator 14 further has an electrical connector **14*c* comprising electrical terminals that are electrically connected to appropriate terminals of an engine management computer 22 that supplies an electrical purge control signal that controls the operation of canister purge flow regulator 14. Under engine operating conditions conducive to canister purging, an appropriate purge control signal from computer 22 causes an appropriate opening of canister purge flow regulator 14. Collected fuel vapor is sucked from canister 12 through canister purge flow regulator 14 to intake manifold 18 by the vacuum that is present in intake manifold 18 due to the running of engine 16. Details of canister purge flow regulator 14 will now be explained with reference to FIG. 2**.

Canister purge flow regulator 14 comprises a housing 26 composed of several parts, including parts **26*a*, 26*b*, 26*c*, and 26*d*, assembled together. These housing parts are preferably injection molded from a suitable plastic material that is electrically non-conductive. Part 26*a* comprises inlet port 14*i* and outlet port 14*o* formed as respective nipples projecting generally radial to an imaginary axis 28, although it is to be appreciated that geometrical variations may occur in different models of the inventive device for various reasons, such as to accommodate packaging installation in particular vehicle models. Parts 26*b*, 26*d* are shown disposed along axis 28 to one axial side of part 26***a* while part 26*c* is disposed to the opposite axial side.

Parts 26*b*, 26*d* form an enclosure for hermetically enclosing a solenoid coil assembly 30 that is coaxial with axis 28. Assembly 30 comprises a coil 30*c* and associated stator parts 30*s*, 30*d*. Part 30*s* is a ferromagnetic shell that encloses the top, side and bottom of coil 30*c* except for leaving an opening for an associated armature 32 at the bottom. Part 30*d* is a ferromagnetic core whose top end is disposed against the top end wall of shell 30*c* and which extends centrally coaxially into the open center of coil 30*c*, but stops short of the opposite end of shell 30*s*. Electrical connector 14*c* is provided in part 26*d* and comprises an integral surround disposed in surrounding relation to electrical terminals 36, 38 that are exposed on the exterior of housing 26 and extend into the enclosure to make electrical connection with magnet wire that forms coil 30*c*. Where armature 32 passes into the open center of assembly 30, part 26*b* may be shaped with a cylindrical wall that provides guidance for axial motion of the armature along axis 28.

Part 26*b* is also shaped to form a walled chamber space 40 coaxially below solenoid assembly 30. This chamber space has a generally circular shape with a perimeter rim 42 that fits against, and is joined to, part 26*a*. Part 26*a* is shaped to form a walled chamber space 44 with a perimeter rim 46 to which rim 42 is joined. The Joined perimeter rims 42, 46 capture, in sealed manner, the perimeter margin of a diaphragm member 48 that forms part of a movable wall 50 that divides chamber spaces 40, 44 from each other. The central region of movable wall 50 contains a rigid bearing member 52, and movable wall 50 is joined to armature 32 by a fastener 54 that secures the center of bearing member 52 to the lower end of armature 32 coaxial with axis 28.

A valve element 56 is centrally secured to the face of movable wall 50 opposite armature 32 coaxial with axis 28 and comprises a perimeter margin 57 shown sealing against an axial end surface 58 of a cylindrical wall 60 that is formed in part 26*a* coaxial with axis 28. A helical coil spring 62 is disposed within chamber space 40 circumferentially about, but spaced radially outwardly of, armature 32 to have one axial end seated in a seat 63 of part 26*b* and the opposite axial end bearing forcefully against movable wall 50 at the perimeter margin of member 52 to bias the perimeter of valve element 56 into sealing engagement with surface 58.

Chamber space 40 is fluid-tight except for a path of communication to inlet port 14*i*. An elbow 64 that is integrally formed in part 26*b* and that registers at one end with a through-hole in the side wall of the nipple that forms inlet port 14*i* provides, in conjunction with that through-hole, a passageway 66 for chamber space 40 to be placed in communication with inlet port 14*i*. The joint surrounding passageway 66 where the two parts 26*a*, 26*b* fit together is sealed fluid-tight by an O-ring seal 68.

Opposite its end surface 58, cylindrical wall 60 comprises an axial end surface 70 that is disposed within an interior space 72 of housing 26. Interior space 72 is cooperatively defined by parts 26*a*, 26*c* being joined together in fluid-tight manner at a joint 74. The nipple that forms outlet port 14*o* is in communication with, and extends radially outward from, this interior space.

A number of circumferentially spaced apart guide elements 76 extend radially inward from the inner surface of wall 60 to form a guideway that is coaxial with axis 28 and that is used to guide a valve assembly 78 for motion along axis 28, as will be explained in more detail later. The circumferential spacing between guides 76 provides channels 77 for some of the purge flow when the canister purge flow regulator is functioning to purge the canister.

Figure 2:
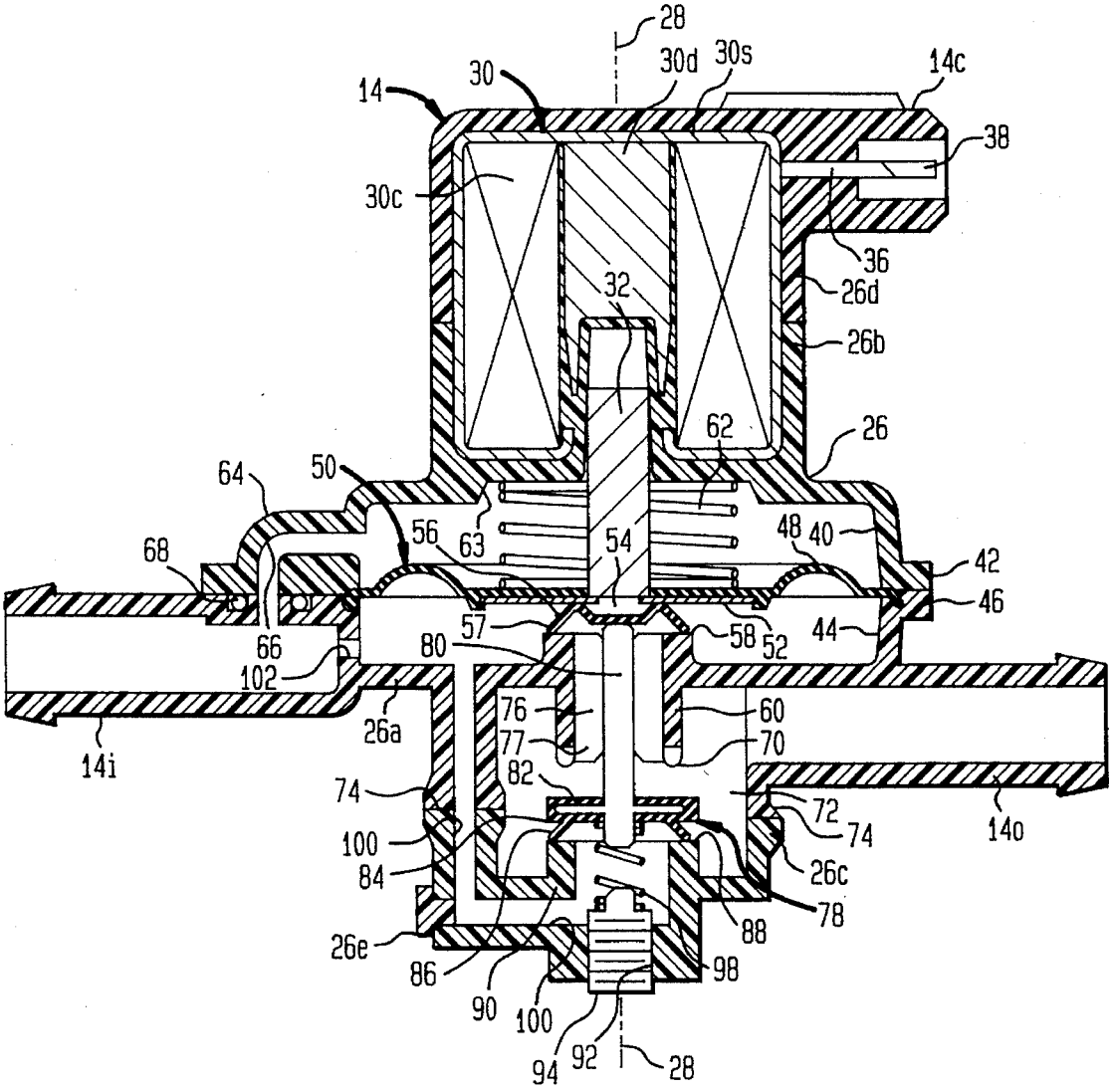
FIG. 2 is a vertical cross sectional view through a canister purge flow regulator embodying principles of the present invention.

Valve assembly 78 comprises a cylindrical shaft 80 that is guided by the guideway formed by guide elements 76. Proximate its lower axial end, shaft 80 comprises a circular flange 82 that supports a valve element 84 on shaft 80 to form valve assembly 78. The position shown in FIG. 2 depicts a perimeter margin 86 of valve element 84 sealing against an axial end surface 88 of a cylindrical wall 90 that is formed in part 26*c* coaxial with axis 28. The lower axial end of wall 90 is closed by a transverse end wall that contains a threaded hole 92 into which a set screw 94 is threaded coaxial with axis 28. Set screw 94 has a suitably shaped head that is accessible from the exterior of housing 26 via a suitable turning tool (not shown) for setting the position of set screw 94 along axis 28. Internally of housing 26, the set screw has a shoulder forming a tip end for fitting to the lower axial end of a small helical coiled spring 98. The lower axial end of shaft 80 protrudes below the portion of valve element 84 that fits onto flange 82 for fitting to the upper axial end of spring 98. The extent to which set screw 94 is threaded into hole 92 sets the extent to which spring 98 is compressed, and hence the force that is exerted by spring 98 on valve assembly 78 urging shaft 80 against movable wall 50.

A passageway 100 that is formed by portions of parts 26*a*, 26*c* communicates chamber space 44 to the space that is bounded by interior surfaces of wall 90. A plug 26*e* closes a hole that is created as a result of injection molding the radial portion of passageway 100 in part 26*c*, but without obstructing the passageway's communication with chamber space 44.

Chamber space 44 is also communicated to inlet port 14*i* by an orifice 102 that extends through the side wall of part 26*a* at the location of the radially inner end of the nipple forming inlet port 14*i*. This orifice has a differential pressure vs. flow characteristic that is important in the operation of the canister purge flow regulator. The operation of the canister purge flow regulator will now be explained.

FIG. 2 shows a condition where there is no current flow in solenoid coil 30*c* and where atmospheric pressure is present at both ports 14*i*, 14*o* and within the interior spaces of housing 26. Spring 62 exerts a resilient bias force on movable wall 50 that causes the perimeter margins 57, 86 of the respective valve elements 56, 84 to seal against the respective surfaces 58, 88. Although shaft 80 is not attached or otherwise joined to movable wall 50, it does exert an upward force against wall 50 in an amount set by spring 98 for the purpose of calibration, to be explained in more detail later. This upward force is sufficient to assure that valve assembly 78 will track, or follow, the motion of the center of movable wall 50 so that the two valve elements will move bi-directionally in unison along axis 28, but it is insufficient in relation to the force of spring 62 to cause the two perimeter margins 57, 86 to lose sealing engagement with their respective surfaces 58, 88. The lower axial end of wall 60 is disposed to allow ample travel of valve assembly 78, but includes notches that would prevent obstruction if abutted by the portion of the assembly containing the valve element and flange.

In the FIG. 2 condition, valve element 56 is closing the upper end of wall 60 while valve element 84 is closing the upper end of wall 90. Accordingly, two parallel branch flow paths by which chamber space 44 would communicate with outlet port 14*o* are obturated. Specifically, valve element 84 obturates a first branch flow path through passageway 100, the interior of wall 90 and space 72, while valve element 56 obturates a second branch flow path that comprises the channels 77 that extend axially along the inside of wall 60 and lead to space 72. Since inlet port **14*i* is in communication with chamber space 44 by virtue of orifice 102, the flow path through housing 26 between inlet port 14*i* and outlet port 14*o*** (and which includes the two branch flow paths just mentioned) is also obturated.

When engine 16 operates, vacuum is created in intake manifold 18, and this vacuum is communicated to outlet port **14*o*. The two valve elements 56, 84 are both exposed to this vacuum, but the resulting forces act in opposite directions along axis 28. If the area of one valve element that is exposed to this vacuum is equal to the area of the other valve element that is exposed to this vacuum, then one force is canceled by the other due to the novel construction that has been disclosed. Hence, variations in intake manifold vacuum (negative pressure) have essentially no effect on the actuating force required to open the inventive canister purge flow regulator to commence purging of canister 12**.

Opening of the purge flow path through canister purge flow regulator 14 between inlet port **14*i* and outlet port 14*o* is performed by the purge flow regulator's actuating mechanism. When solenoid coil 30*c* is energized with a suitable electric current, which is typically created by applying a pulse width modulated voltage from computer 22 to terminals 36, 38, armature 32 is drawn into the solenoid. This electric current must be large enough to create a magnetic force that overcomes the bias spring force holding the two valve elements 56, 84** seated closed against their respective seating surfaces.

Upward motion of armature 32 displaces the central region of movable wall 50 upwardly, unseating both valve elements 56, 86 and opening both branch flow paths. Vapors collected in canister 12 will now flow through purge flow regulator 14 to intake manifold 18 because of intake manifold vacuum being applied to outlet port **14*o*. After passing through the nipple forming inlet port 14*i*, the purged vapors flow through orifice 102 and into chamber space 44. From chamber space 44, the flow divides through the two parallel branch paths, reuniting to exit through the nipple forming outlet port 14*o*. Once valve elements 56, 84 have been opened, negative differential pressure created in chamber space 44 due to exposure to intake manifold vacuum will be effective on the entirety of movable wall 50**.

Orifice 102 has a differential pressure vs. flow characteristic that accommodates the requisite maximum purge flow, but limits the extent to which differential pressure at inlet port **14*i* can drop below the canister purge port differential pressure (which is typically only slightly subatmospheric, i.e. slightly negative, during purging) so that the pressure at inlet port 14*i*, and hence that in chamber space 40, will be at atmospheric or just slightly sub-atmospheric during all operating conditions. Although the differential pressure drop across orifice 102 during purging will equal the pressure differential between the two chamber spaces 40, 44, whatever pressure differential exists across movable wall 50 will be due mostly to the negative pressure in chamber space 44. As the purge flow increases, so does the differential pressure drop across orifice 102. Upward motion of movable wall 50 will cease when the difference between the pressures in chamber spaces 40, 44 reaches a value where the sum of the net force on movable wall due to that difference plus the downward force exerted by spring 62 equals the sum of the force exerted by spring 92 and the force exerted by armature 32. Flow proportional to the electrical purge control input signal will be maintained regardless of any changes in manifold vacuum or canister purge port differential pressure since movable wall 50 senses the differential pressure drop across orifice 102 and will automatically reposition itself to maintain the commanded flow in response to any such changes. Approximately linear operation can be accomplished by suitable shaping of the magnetic interface between armature 32 and stator core 30*c*, such as tapering the latter as shown in FIG. 2**.

Figure 3:
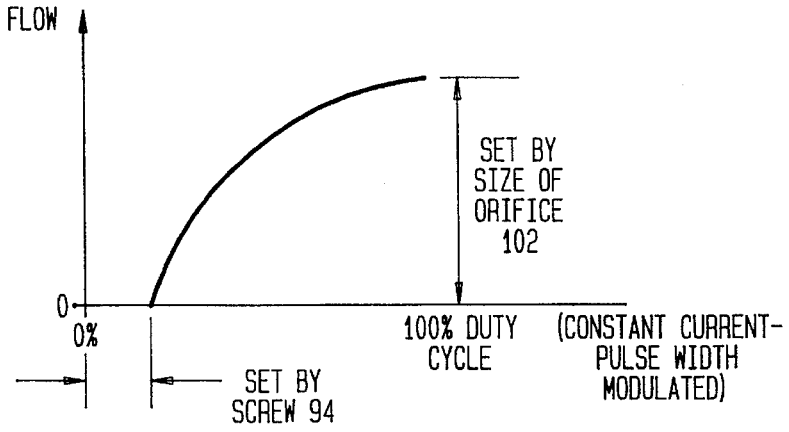
FIG. 3 is a graph plot useful in explaining certain aspects of operation of the canister purge flow regulator.

FIG. 3 show a representative flow vs. duty cycle characteristic for an inventive canister purge flow regulator. The horizontal axis represents the duty cycle of the pulse width modulated purge control signal input from computer 22. The vertical axis represents purge flow through the purge flow regulator. The maximum flow is established by the size of orifice 102. The duty cycle required of the electrical input in order to open the purge flow regulator is established by the setting of screw 94. It is to be appreciated that any given model of the inventive purge flow regulator will be designed using conventional engineering principles based on the foregoing disclosure. While the preferred embodiment has disclosed that the two valves are of equal areas, some degree of compensation for variations in manifold vacuum can be achieved if the valve areas exposed to manifold vacuum when obturating the respective branch paths are not exactly equal. Because of the offsetting forces acting on movable wall 50, it becomes possible for the diameter of the movable wall to be smaller than in certain other devices not utilizing this inventive feature of the instant purge flow regulator.

While a presently preferred embodiment has been illustrated and described, it is to be appreciated that principles are applicable to other embodiments that fall within the scope of the following claims.

What is claimed is:

1. A canister purge flow regulator for regulating purge flow of volatile fuel vapors from a fuel vapor collection canister to an internal combustion engine intake manifold for entrainment with induction flow into an engine in accordance with a purge control input signal to said canister purge flow regulator, said canister purge flow regulator comprising:

a) a housing comprising inlet port means adapted to be placed in flow communication with a fuel vapor collection canister and outlet port means adapted to be placed in flow communication with an intake manifold of an internal combustion engine;

b) actuating means comprising a movable wall that divides a portion of said housing into first and second chamber spaces;

c) means for communicating said inlet port means to said first chamber space to cause pressure in said first chamber space to substantially equal pressure at said inlet port means;

d) means defining a vapor purge flow path through said housing between said inlet port means and said outlet port means;

e) said vapor purge flow path through said housing comprising orifice means through which vapor flow from said inlet port means to said outlet port means is constrained to pass and which is disposed to communicate said inlet port means to said second chamber space, said orifice means having a differential pressure versus flow characteristic that provides a predetermined pressure drop at maximum flow through said orifice means such that under an operating condition wherein pressure in said second chamber space approximates intake manifold pressure, pressure at said inlet port means remains significantly above that in said second chamber space;

f) said vapor purge flow path comprising first and second parallel branch paths each disposed to communicate said second chamber space to said outlet port means;

g) first valve means for controlling flow through said first branch path;

h) second valve means for controlling flow through said second branch path;

i) means for operatively relating said first valve means and said second valve means for hi-directional motion in unison;

j) said actuating means comprising resilient biasing means for causing said first valve means and said second valve means to both be resiliently biased closed to obturate said vapor purge flow path in the absence of a purge control signal commanding opening of said vapor purge flow path; and k) means for causing pressure at said outlet port means to be applied to one of said first valve means and said second valve means in one direction of said bi-directional motion and to the other of said first valve means and said second valve means in another direction of said bi-directional motion when said first valve means and said second valve means are both closed; and l) said actuating means comprising means for acting on said movable wall to cause said first valve means and said second valve means to move in unison in said one direction and respectively open said first branch path and said second branch path in response to a purge control signal commanding opening of said vapor purge flow path whereby the effect of pressure variations at said outlet port means on operation of said actuating means to operate said first valve means and second valve means in unison from closed to open in response to a purge control input signal commanding opening of said vapor purge flow path is made a function of any difference between respective effective areas of said first valve means and of said second valve means that are respectively exposed to pressure at said outlet port means when both said first valve means and said second valve means are closed.

2. A canister purge flow regulator as set forth in claim 1 in which said effective area of said first valve means exposed to pressure at said outlet port means is substantially equal to said effective area of said second valve means exposed to pressure at said outlet port means.

3. A canister purge flow regulator as set forth in claim 1 in which said one direction and said another direction are in opposite senses along a linear axis.

4. A canister purge flow regulator as set forth in claim 3 in which said first valve means comprises a first valve element disposed on a central region of said movable wall within said second chamber space, said second valve means comprises a second valve element disposed coaxially on a member having a shaft that extends coaxially away from said second valve member and that is engaged by a linear guide means internal to said housing for guiding said member for linear motion along said linear axis, and said means for operatively relating said first valve means and said second valve means for bi-directional motion in unison comprises spring bias means for causing said member to be resiliently biased in said one direction and thereby bias said shaft against said first valve means to cause said second valve means to track the motion of said first valve means when a purge control signal commands opening of said vapor purge flow path.

5. A canister purge flow regulator as set forth in claim 4 in which said resilient biasing means for causing said first valve means and said second valve means to both be resiliently biased closed to obturate said vapor purge flow path in the absence of a purge control signal commanding opening of said vapor purge flow path comprises spring means that acts on said movable wall to resiliently urge said movable wall toward said second chamber space.

6. A canister purge flow regulator as set forth in claim 5 in which said spring means is disposed in said first chamber space.

7. A canister purge flow regulator as set forth in claim 4 in which said linear guide means comprises a series of circumferentially spaced apart guides projecting radially inwardly from a cylindrical internal wall of said housing toward said shaft, said cylindrical internal wall has one axial end that is disposed in said second chamber space and that comprises a surface forming a seat on which a perimeter margin of said first valve element seats when said first valve means is closed, and the circumferential spacing of said guides forms a lengthwise segment of said first branch path.

8. A canister purge flow regulator as set forth in claim 7 in which said cylindrical internal wall has another axial end that is opposite said one axial end and that, when said first valve means and said second valve means are both closed, is spaced from said second valve element sufficiently to allow said second valve means to move in unison with said first valve means along a predetermined distance, and means for preventing said second valve means from blocking flow through said segment of said first branch path at all positions of movement along said predetermined distance.

9. A canister purge flow regulator as set forth in claim 4 further including calibration means for setting said spring bias means to cause said shaft to be resiliently biased against said first valve means with a desired bias force.

10. A canister purge flow regulator as set forth in claim 9 in which said calibration means comprises a calibration member that is accessible externally of said housing for selective positioning relative to said housing for setting said spring bias means.

11. A canister purge flow regulator as set forth in claim 1 in which said inlet port means comprises a nipple that provides flow communication with both said first chamber space and said orifice means.

12. A canister purge flow regulator as set forth in claim 1 in which said actuating means comprises a solenoid having an armature that is operatively coupled with said movable wall for positioning said movable wall within said first chamber space when said solenoid is energized by a purge control signal to said solenoid commanding opening of said vapor purge flow path.

13. A canister purge flow regulator for regulating purge flow of volatile fuel vapors from a fuel vapor collection canister to an internal combustion engine intake manifold for entrainment with induction flow into an engine in accordance with a purge control input signal to said canister purge flow regulator, said canister purge flow regulator comprising:

a) a housing comprising inlet port means adapted to be placed in flow communication with a fuel vapor collection canister and outlet port means adapted to be placed in flow communication with an intake manifold of an internal combustion engine;

b) means defining a vapor purge flow path through said housing between said inlet port means and said outlet port means;

c) actuating means for receiving a purge control input signal;

d) valve means operated by said actuating means for opening and closing said vapor purge flow path in response to a purge control input signal to said actuating means, said valve means being directly exposed to pressure at said outlet port means;

e) said actuating means comprising resilient biasing means for causing said valve means to be resiliently biased to closed position to obturate said vapor purge flow path in the absence of a purge control signal commanding opening of said vapor purge flow path; and f) pressure compensating means operable when said valve means is in closed position for causing pressure at said outlet port means to also be effective on said valve means in opposition to the pressure of said outlet port means to which said valve means is directly exposed upon said actuating means opening said valve means from closed position whereby the effect of pressure variations at said outlet port means on operation of said actuating means to operate said valve means from closed position to open in response to a purge control input signal commanding opening of said vapor purge flow path is made a function of any difference between an effective area of said valve means that is exposed to pressure at said outlet port means and the extent to which said pressure compensating means is effective on said valve means.

14. A canister purge flow regulator as set forth in claim 13 in which said pressure compensating means comprises means to substantially cancel the effect of pressure variations at said outlet port means on operation of said actuating means to operate said valve means from closed position to open in response to a purge control input signal commanding opening of said vapor purge flow path.

15. A canister purge flow regulator for regulating purge flow of volatile fuel vapors from a fuel vapor collection canister to an internal combustion engine intake manifold for entrainment with induction flow into an engine in accordance with a purge control input signal to said canister purge flow regulator, said canister purge flow regulator comprising:

a) a housing comprising inlet port means adapted to be placed in flow communication with a fuel vapor collection canister and outlet port means adapted to be placed in flow communication with an intake manifold of an internal combustion engine;

b) means defining a vapor purge flow path through said housing between said inlet port means and said outlet port means;

c) actuating means that is operated by a purge control input signal to said actuating means commanding opening of said vapor purge flow path comprising a movable wall that divides a portion of said housing into first and second chamber spaces and that moves toward said first chamber space in response to a purge control input signal commanding opening of said vapor purge flow path;

d) valve means operated by said movable wall for opening said vapor purge flow path in response to a purge control input signal to said actuating means commanding opening of said vapor purge flow path;

e) said actuating means comprising resilient biasing means for causing said valve means to be resiliently biased to closed position to obturate said vapor purge flow path in the absence of a purge control signal commanding opening of said vapor purge flow path; and f) means for communicating said inlet port means to said first chamber space to cause pressure in said first chamber space to substantially equal pressure at said inlet port means.

16. A canister purge flow regulator as set forth in claim 15 in which said valve means is directly exposed to pressure at said outlet port means when said valve means is in closed position, and further including pressure compensating means operable when said valve means is in closed position for causing pressure at said outlet port means to also be effective on said valve means in opposition to the pressure at said outlet port means to which said valve means is directly exposed whereby upon said movable wall opening said valve means from closed position in response to a purge control signal commanding opening of said vapor purge flow path, the effect of pressure variations at said outlet port means on operation of said movable wall to operate said valve means from closed position to open in response to a purge control input signal commanding opening of said vapor purge flow path is made a function of any difference between an effective area of said valve means that is exposed to pressure at said outlet port means when said valve means is in closed position and the extent to which said pressure compensating means is effective on said valve means in closed position of said valve means.

17. A canister purge flow regulator as set forth in claim 16 in which said pressure compensating means comprises means to substantially cancel the effect of pressure variations at said outlet port means on operation of said movable wall to operate said valve means from closed position to open in response to a purge control input signal commanding opening of said vapor purge flow path.

18. A canister purge flow regulator for regulating purge flow of volatile fuel vapors from a fuel vapor collection canister to an internal combustion engine intake manifold for entrainment with induction flow into an engine in accordance with a purge control input signal to said canister purge flow regulator, said canister purge flow regulator comprising:

a) a housing comprising inlet port means adapted to be placed in flow communication with a fuel vapor collection canister and outlet port means adapted to be placed in flow communication with an intake manifold of an internal combustion engine;

b) means defining a vapor purge flow path through said housing between said inlet port means and said outlet port means;

c) actuating means for receiving a purge control input signal;

d) valve means operated by said actuating means for opening and closing said vapor purge flow path in response to a purge control input signal to said actuating means;

e) said actuating means comprising resilient biasing means for causing said valve means to be resiliently biased to closed position to obturate said vapor purge flow path in the absence of a purge control signal commanding opening of said vapor purge flow path;

f) said vapor purge flow path comprising first and second parallel branch paths; and g) said valve means comprising first valve means operated by said actuating means for controlling flow through said first branch path and second valve means that is resiliently biased against said first valve means to follow the operation of said first valve means by said actuating means for controlling flow through said second branch path.

19. A canister purge flow regulator as set forth in claim 18 in which said first valve means and said second valve means are bi-directionally movable in unison, and when both said first valve means and said second valve means are closed, pressure at said outlet port means is applied to one of said first valve means and said second valve means in one direction of their hi-directional motion and to the other of said first valve means and said second valve means in another direction of their hi-directional motion whereby the effect of pressure variations at said outlet port means on operation of said actuating means to operate said first valve means and second valve means in unison from closed to open in response to a purge control input signal commanding opening of said vapor purge flow path is made a function of any difference between respective effective areas of said first valve means and of said second valve means that are respectively exposed to pressure at said outlet port means when both said first valve means and said second valve means are closed.

20. A canister purge flow regulator as set forth in claim 19 in which said effective area of said first valve means exposed to pressure at said outlet port means is substantially equal to said effective area of said second valve means exposed to pressure at said outlet port means.

21. An evaporative emission control system for an automotive vehicle having an internal combustion engine and a fuel tank that holds a supply of fuel for the engine comprising:

a) a fuel vapor collection canister for collecting volatile fuel vapors from the fuel tank;

b) a canister purge flow regulator for regulating purge flow of volatile fuel vapors from said fuel vapor collection canister to an intake manifold of the engine for entrainment with induction flow into the engine in accordance with a purge control input signal to said canister purge flow regulator;

c) said canister purge flow regulator comprising:

1) a housing comprising inlet port means in flow communication with said fuel vapor collection canister and outlet port means in flow communication with the engine intake manifold;

2) actuating means comprising a movable wall that divides a portion of said housing into first and second chamber spaces;

3) means for communicating said inlet port means to said first chamber space to cause pressure in said first chamber space to substantially equal pressure at said inlet port means;

4) means defining a vapor purge flow path through said housing between said inlet port means and said outlet port means;

5) said vapor purge flow path through said housing comprising orifice means through which vapor flow from said inlet port means to said outlet port means is constrained to pass and which is disposed to communicate said inlet port means to said second chamber space, said orifice means having a pressure versus flow characteristic that provides a predetermined pressure drop at maximum flow through said orifice means such that under an operating condition wherein pressure in said second chamber space approximates intake manifold pressure, pressure at said inlet port means remains significantly above that in said second chamber space;

6) said vapor purge flow path comprising first and second parallel branch paths each disposed to communicate said second chamber space to said outlet port means;

7) first valve means for controlling flow through said first branch path;

8) second valve means for controlling flow through said second branch path;

9) means for operatively relating said first valve means and said second valve means for bi-directional motion in unison;

10) said actuating means comprising resilient biasing means for causing said first valve means and said second valve means to both be resiliently biased closed to obturate said vapor purge flow path in the absence of a purge control signal commanding opening of said vapor purge flow path; and 11) means for causing pressure at said outlet port means to be applied to one of said first valve means and said second valve means in one direction of said bi-directional motion and to the other of said first valve means and said second valve means in another direction of said bi-directional motion when said first valve means and said second valve means are both closed; and 12) said actuating means comprising means for acting on said movable wall to cause said first valve means and said second valve means to move in unison in said one direction and respectively open said first branch path and said second branch path in response to a purge control signal commanding opening of said vapor purge flow path whereby the effect of pressure variations at said outlet port means on operation of said actuating means to operate said first valve means and second valve means in unison from closed to open in response to a purge control input signal commanding opening of said vapor purge flow path is made a function of any difference between respective effective areas of said first valve means and of said second valve means that are respectively exposed to pressure at said outlet port means when both said first valve means and said second valve means are closed.

22. An evaporative emission control system for an automotive vehicle having an internal combustion engine and a fuel tank that holds a supply of fuel for the engine comprising:

a) a fuel vapor collection canister for collecting volatile fuel vapors from the fuel tank;

b) a canister purge flow regulator for regulating purge flow of volatile fuel vapors from said fuel vapor collection canister to an intake manifold of the engine for entrainment with induction flow into the engine in accordance with a purge control input signal to said canister purge flow regulator, said canister purge flow regulator comprising:

1) a housing comprising inlet port means in flow communication with a fuel vapor collection canister and outlet port means in flow communication with the engine intake manifold;

2) means defining a vapor purge flow path through said housing between said inlet port means and said outlet port means;

3) actuating means for receiving a purge control input signal;

4) valve means operated by said actuating means for opening and closing said vapor purge flow path in response to a purge control input signal to said actuating means, said valve means being directly exposed to pressure at said outlet port means;

5) said actuating means comprising resilient biasing means for causing said valve means to be resiliently biased to closed position to obturate said vapor purge flow path in the absence of a purge control signal commanding opening of said vapor purge flow path; and 6) pressure compensating means operable when said valve means is in closed position for causing pressure at said outlet port means to also be effective on said valve means in opposition to the pressure of said outlet port means to which said valve means is directly exposed upon said actuating means opening said valve means from closed position whereby the effect of intake manifold pressure variations on operation of said actuating means to operate said valve means from closed position to open in response to a purge control input signal commanding opening of said vapor purge flow path is made a function of any difference between an effective area of said valve means that is exposed to intake manifold pressure and the extent to which said pressure compensating means is effective on said valve means.

23. An evaporative emission control system for an automotive vehicle having an internal combustion engine and a fuel tank that holds a supply of fuel for the engine comprising:

a) a fuel vapor collection canister for collecting volatile fuel vapors from the fuel tank;

b) a canister purge flow regulator for regulating purge flow of volatile fuel vapors from said fuel vapor collection canister to an intake manifold of the engine for entrainment with induction flow into the engine in accordance with a purge control input signal to said canister purge flow regulator, said canister purge flow regulator comprising:

1) a housing comprising inlet port means in flow communication with said fuel vapor collection canister and outlet port means in flow communication with the engine intake manifold;

2) means defining a vapor purge flow path through said housing between said inlet port means and said outlet port means;

3) actuating means that is operated by a purge control input signal to said actuating means commanding opening of said vapor purge flow path comprising a movable wall that divides a portion of said housing into first and second chamber spaces and that moves toward said first chamber space in response to a purge control input signal commanding opening of said vapor purge flow path;

4) valve means operated by said movable wall for opening said vapor purge flow path in response to a purge control input signal to said actuating means commanding opening of said vapor purge flow path;

5) said actuating means comprising resilient biasing means for causing said valve means to be resiliently biased to closed position to obturate said vapor purge flow path in the absence of a purge control signal commanding opening of said vapor purge flow path; and 6) means for communicating said inlet port means to said first chamber space to cause pressure in said first chamber space to substantially equal pressure supplied from said canister to said inlet port means.

24. An evaporative emission control system for an automotive vehicle having an internal combustion engine and a fuel tank that holds a supply of fuel for the engine comprising:

a) a fuel vapor collection canister for collecting volatile fuel vapors from the fuel tank;

b) a canister purge flow regulator for regulating purge flow of volatile fuel vapors from said fuel vapor collection canister to an intake manifold of the engine for entrainment with induction flow into the engine in accordance with a purge control input signal to said canister purge flow regulator, said canister purge flow regulator comprising:

1) a housing comprising inlet port means in flow communication with said fuel vapor collection canister and outlet port means in flow communication with the engine intake manifold;

2) means defining a vapor purge flow path through said housing between said inlet port means and said outlet port means;

3) actuating means for receiving a purge control input signal;

4) valve means operated by said actuating means for opening and closing said vapor purge flow path in response to a purge control input signal to said actuating means;

5) said actuating means comprising resilient biasing means for causing said valve means to be resiliently biased to closed position to obturate said vapor purge flow path in the absence of a purge control signal commanding opening of said vapor purge flow path;

6) said vapor purge flow path comprising first and second parallel branch paths; and 7) said valve means comprising first valve means operated by said actuating means for controlling flow through said first branch path and second valve means that is resiliently biased against said first valve means to follow the operation of said first valve means by said actuating means for controlling flow through said second branch path.

* * * * *